United States Patent [19]

Purton et al.

[11] 4,275,842

[45] Jun. 30, 1981

[54] DECOKING NOZZLE ASSEMBLY

[75] Inventors: Robert M. Purton; Lloyd D. Hanson, both of Cerritos, Calif.

[73] Assignee: Dresser Industries, Inc., Dallas, Tex.

[21] Appl. No.: 96,704

[22] Filed: Nov. 21, 1979

[51] Int. Cl.[3] ..... A62C 31/00

[52] U.S. Cl. ..... 239/446

[58] Field of Search ..... 239/246–248, 239/446, 447

[56] References Cited

U.S. PATENT DOCUMENTS

| | | | |
|---|---|---|---|
| 2,217,360 | 10/1940 | Court | 239/248 |
| 2,245,575 | 6/1941 | Court | 239/248 |
| 2,294,719 | 9/1942 | Court | 239/248 |
| 2,538,211 | 1/1951 | Prout | 239/446 |

*Primary Examiner*—James B. Marbert

*Attorney, Agent, or Firm*—Roy L. Van Winkle; John N. Hazelwood

[57] ABSTRACT

The improved decoking nozzle assembly described hereinafter includes both first and second stage decoking nozzles that can be selectively utilized. The nozzle assembly includes a hollow body having ports therein providing fluid flow to the first and second stage nozzles, a sliding valve mechanism inside the hollow body that includes apertures arranged to be selectively aligned with the ports and with the first or second stage nozzles, and a stop member that is engageable with the valve member to retain the valve member in the selected position.

6 Claims, 2 Drawing Figures

DECOKING NOZZLE ASSEMBLY

BACKGROUND OF THE INVENTION

This invention relates generally to improved nozzles for use in the decoking process. More particularly, but not in the way of limitation, this invention relates to an improved decoking nozzle assembly that provides both first and second stage nozzles for use in decoking process.

In the past, it was the practice to utilize first stage nozzles mounted on a body that was connected by means of a quick disconnect coupling into the decoking system. After the use of the first stage nozzles was completed, they were removed from the system. Second stage nozzles were then connected to the system. Sometimes, in the decoking process it has been necessary to change from one nozzle stage to the other rather frequently. The relatively large size of the nozzles and the difficulty of connecting and disconnecting such nozzles, caused the decoking process to be very cumbersome and time-consuming.

An object of this invention is to provide a decoking nozzle assembly that can be connected into the system and that will provide both first and second stage nozzles without the necessity of removing the nozzles from the decoking system.

SUMMARY OF THE INVENTION

This invention provides an improved decoking nozzle assembly that includes a hollow body having upper and lower ports therein with first and second stage nozzles connected to the body adjacent to and in fluid communication with the respective ports. The nozzle assembly includes a valve member that is movably disposed within the hollow body having apertures arranged to be selectively aligned with either the upper or lower ports so that either the first stage or second stage nozzle can be utilized. Means are also provided for moving the valve member between the positions and retaining the valve member in such positions.

BRIEF DESCRIPTION OF THE DRAWING

The foregoing and additional objects and advantages of the invention will become more apparent as the following detailed description is read in conjunction with the accompanying drawing wherein like reference characters denote like parts in all views and wherein.

DETAILED DESCRIPTION OF PREFERRED EMBODIMENT

Figure 1:
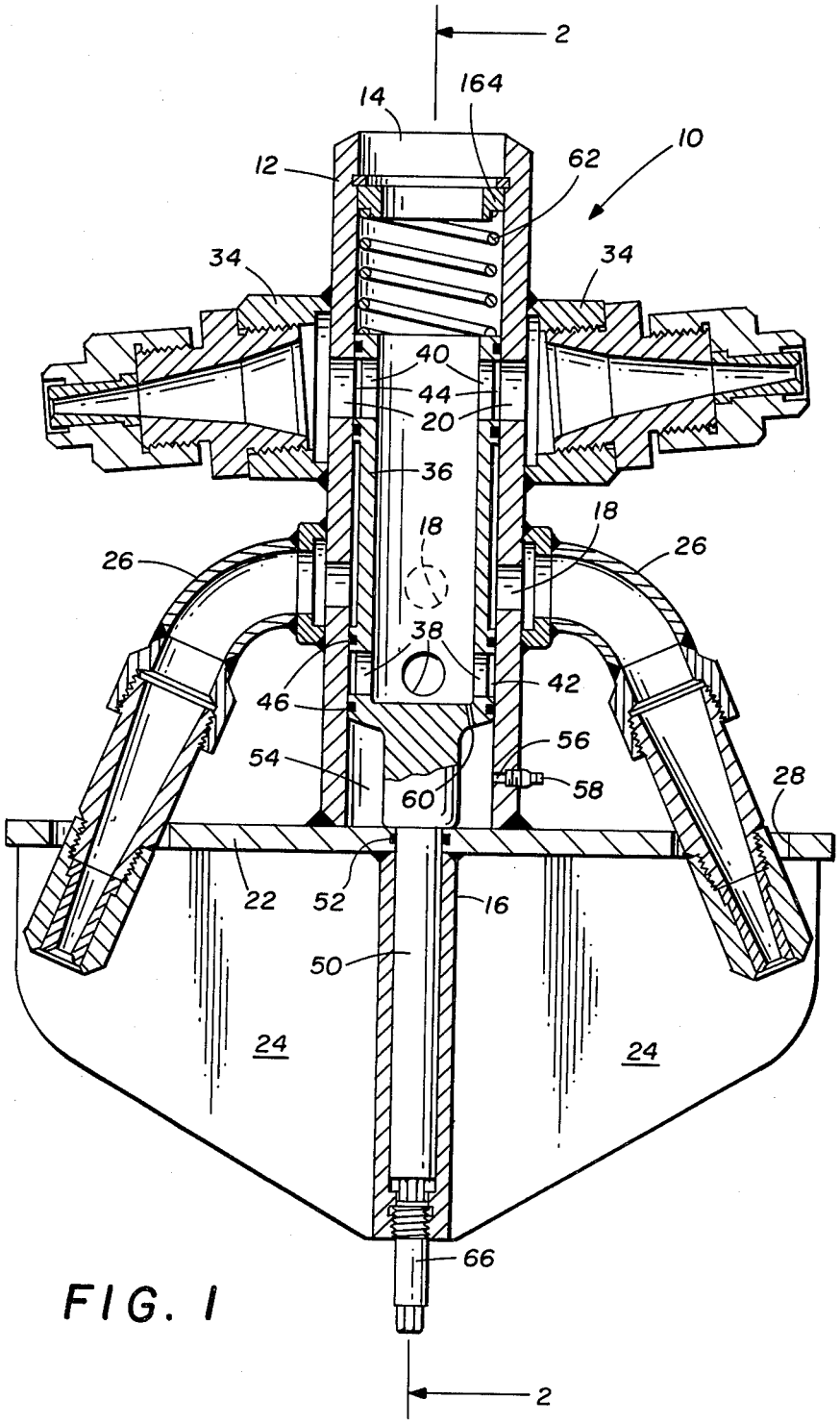
FIG. 1 is a vertical, cross-sectional view of an improved decoking nozzle assembly that is constructed in accordance with the invention.

Referring to the drawing, and to FIG. 1 in particular, shown therein and generally designated by the reference character 10 is an improved decoking nozzle assembly that is constructed in accordance with the invention. The decoking nozzle assembly 10 includes a hollow body 12 having an open upper end 14 that is arranged to be connected by means of threads (not shown) or a flange (not shown) to a conventional decoking system (not shown). The body 12 also has a closed lower end 16 that is substantially reduced in diameter for reasons that will be pointed out hereinafter.

Extending through the side wall of the hollow body 12 are lower ports 18 and upper ports 20. It will be noted, by considering both FIGS. 1 and 2, that there are four lower ports 16 provided and only two diametrically-opposed upper ports 20 provided.

Welded or otherwise affixed to the hollow body 12, is a plate 22 having blade-like members 24 depending therefrom. The members 24 occasionally are used in the decoking process for scraping or cutting as the nozzle assembly 10 is rotated.

Figure 2:
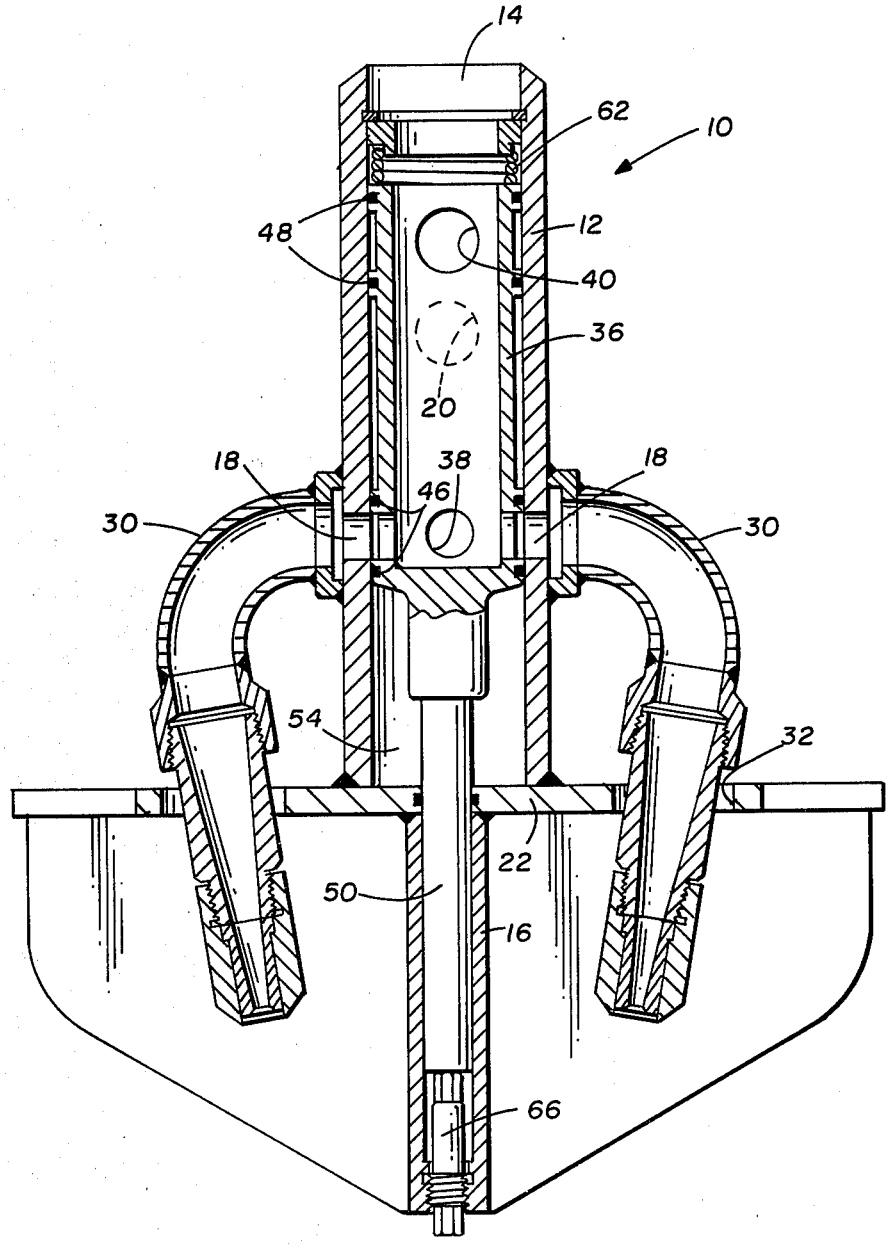
FIG. 2 is a vertical, cross-sectional view taken substantially along the line 2—2 of FIG. 1, but showing the internal parts in a different operating position.

As shown in FIG. 1, the nozzle assembly 10 also includes a pair of outwardly divergent, lower or first stage nozzles 26 that extend through openings 28 formed in the plate 22. Referring to FIG. 2, it can be seen that, displaced approximately 90° from the nozzles 26, there is provided a pair of nozzles 30 that are inwardly convergent and that extend through openings 32 in the plate 22.

In FIG. 1, it can also be seen that there is a pair of outwardly directed, upper or second stage nozzles 34 that are affixed to the body 12 in fluid communication with the upper ports 20 previously mentioned.

Within hollow body 12 there is provided a hollow sliding valve member 36 that includes lower apertures 38 and upper apertures 40. The apertures 38 and 40 are arranged to approximately align with the lower and upper ports 18 and 20 respectively, as will be described. However, it should be pointed out that the apertures 38 extend through the wall of the valve member 36 terminating in an annular recess 42 and similarly, the apertures 40 terminate in an annular recess 44 that is formed in the outer periphery of the valve member 36. The annular recesses 42 and 44 are provided to be certain that fluid communication will occur through the ports and apertures, even if the apertures are not precisely aligned circumferentially with the ports.

Isolating the lower apertures 38 are a pair of spaced seals 46 which prevent flow therethrough from the interior of the valve member 36 unless the apertures 38 are aligned with the lower ports 18 as shown in FIG. 2. Similarly, spaced seals 48 are provided to isolate the upper apertures 40 and prevent flow therethrough except when the apertures 40 are aligned with the ports 20 as illustrated in FIG. 1.

It will be noted that the valve member 36 includes a lower closed end that has a portion 50 of substantially reduced diameter projecting into the lower end of portion 16 of the housing 12. A seal 52 is located in the plate 22 in sealing engagement with the portion 50.

The closed lower end of the body 12, the valve member 30 and the valve member 36 form a chamber 54. A passageway 56 having a quick disconnect coupling 58 mounted therein extends through the hollow body 12 into the chamber 54. The passageway 56 and quick disconnect 58 are provided so that a conduit (not shown) can be connected thereto to place fluid under pressure in the chamber 54 to drive the valve member 36 upwardly to the position illustrated in FIG. 2 for reasons that will be discussed hereinafter.

In FIG. 1, a small equalizing port 60 can be seen extending from the interior of the hollow valve member 36 into the chamber 54. The equalizing port 60 is very small in diameter so that fluid pressure in the chamber 54 will raise the valve member 36 and, yet, is of sufficient size to permit equalization of the fluid pressure therein after the valve member 36 has been moved.

To constantly urge the valve member 36 toward the osition illustrated in FIG. 1, there is provided a com-ression spring 62 that has one end in engagement with he upper end of the valve member 36 and the other end n engagement with a spring stop 64 located in and ffixed to the upper end 14 of hollow body 12.

The lower reduced diameter end portion 50 of the alve member 36 is illustrated in FIG. 1 as being in ngagement with a stop member 66 that is threadedly ttached to the lower closed end portion 16 of the hol-ow body 12. When the valve member 36 is in the posi-ion illustrated in FIG. 1, it will be noted that a consid-rable portion of the stop member 66 projects from the ody 12. Referring to FIG. 2, it can be seen that the alve member 36 has been displaced upwardly against he force exerted by the spring 62. As soon as the valve nember 36 has been displaced to this position, the stop nember 66 is unthreaded from the hollow body 12 nverted and replaced therein as illustrated in FIG. 2 so hat the valve member 36 will be retained in the upper osition shown.

OPERATION OF THE PREFERRED EMBODIMENT

In the initial operation of decoking, the valve member 6 will be in the position illustrated in FIG. 2, that is, vith the valve member 36 at its uppermost position ligning the apertures 38 with the lower ports 18 in the ody 12. It can be seen that in this position, the aper-ures 40 are not aligned with the ports 20, and that no luid can flow through the upper nozzles 34. All the luid then is diverted through the lower nozzles 26 and 0 until such time as the initial phase of the decoking has een completed.

Upon completion of the initial phase, the stop 66 is nscrewed from the body 12 and the spring 62 drives he valve member 36 downwardly to the position hown in FIG. 1. The stop member 66 is then inverted nd replaced. When in this position, the valve member 6 is in its lowermost position and the ports 18 and pertures 38 are not aligned so no fluid can flow hrough the nozzles 26 or 30. Ports 20 and apertures 40 re in alignment so that fluid flow is directed outwardly hrough the upper or second stage nozzles 34.

During the decoking operation, and as previously nentioned, it is not necessary to remove the nozzle ssembly 10 from the decoking system to change noz-les. The valve 36 can be repositioned as many times as lesired between the upper and lower nozzles with the top 66 being placed in the appropriate position.

It should also be pointed out that while a particular rrangement of nozzles has been illustrated in the as-embly 10, any desired arrangement may be utilized.

Having described but a single embodiment of the nvention, it will be understood that many changes and nodifications can be made thereto without departing rom the spirit of the invention.

The embodiments of the invention in which an exclu-ive property or privilege is claimed are defined as ollows:

1. An improved decoking nozzle comprising:

a hollow body member having a side wall, a closed lower end, and an open upper end arranged to be connected with a decoking system, said body member having flow ports extending through said side wall, said flow ports including a pair of upper ports diametrically opposed and four lower ports located about ninety degrees apart around the circumference of said body;

upper nozzle means connected to said side wall for fluid communication with said upper ports;

lower nozzle means connected to said side wall for fluid communication with said lower ports;

valve means slidingly disposed in the interior of said hollow body member, said valve means including seal means sealingly engaging said side wall;

valve control means for moving said valve means between a first position permitting flow through said lower nozzle means while preventing flow through said upper nozzle means and a second position preventing flow through said lower nozzle means while permitting flow through said upper nozzle means; and, said valve means also including a hollow valve member having a pair of upper apertures, which in the second position of said valve means are in communication with said upper ports, and four lower apertures, which in the first position of said valve means are in communication with said lower ports.

2. The nozzle of claim 1 wherein said control means also includes stop means connected to said body member for retaining said valve means in said first position and moveable to permit said body member to move to said second position.

3. The nozzle of claim 1 and also including resilient means located in said body member urging said hollow valve member toward said second position.

4. The nozzle of claim 3 wherein said valve control means also includes:

a chamber formed adjacent to the lower end of said body member between a closed lower end on said valve member and the closed lower end of said body member;

a relatively small equalizing port extending through said closed lower end of said valve member whereby pressure of fluid above and below the closed lower end of said valve member can slowly become equal;

a resilient member in said body member above said valve member urging said valve member toward said second position; and, means on said body member permitting pressure to be applied in said chamber to move said valve member toward said first position against the urging of said resilient member.

5. An improved decoking nozzle comprising:

a hollow body member having a side wall, a closed lower end, and an open upper end arranged to be connected with a decoking system, said body member having spaced upper and lower flow ports extending through said side wall;

upper nozzle means connected to said side wall for fluid communication with said upper port;

lower nozzle means connected to said side wall for fluid communication with said lower port;

valve means including a hollow valve member slidingly disposed in the interior of said hollow body member, said valve member having a closed lower end and upper and lower apertures arranged to be alternately in fluid communication with a respective one of said upper and lower ports, said valve means including seal means sealingly engaging said side wall and isolating said upper and lower apertures; and, valve control means for moving said valve member between a first position wherein said lower port and apertures are in communication permitting flow through said lower nozzle means and a second position wherein said upper ports and apertures are in communication permitting flow through said upper nozzle means, said control means including a chamber defined by said side wall and the lower ends of said valve member and body member, means permitting the introduction of pressure into said chamber to urge said valve member toward said first position, resilient means urging said valve member toward said second position, and stop means for selectively retaining said valve member in said first position.

6. The nozzle of claim 5 wherein:

the closed lower end of said hollow body member is substantively reduced in diameter;

the closed lower end of said valve member is reduced in diameter and projects into the reduced diameter portion of said body member;

a seal member forming a fluid tight sliding seal between said lower ends; and, said stop means including an elongate member removably positioned in the lower end of said body member and engageable with the lower end of said valve member.

* * * * *